US005422698A

United States Patent [19]

Kawada et al.

[11] Patent Number: 5,422,698

[45] Date of Patent: Jun. 6, 1995

[54] PHOTOSENSITIVE MATERIAL PROCESSING APPARATUS

[75] Inventors: Ken Kawada; Takatoshi Ishikawa, both of Kanagawa, Japan

[73] Assignee: Fuji Photo Film Co., Ltd., Kanagawa, Japan

[21] Appl. No.: 128,160

[22] Filed: Sep. 29, 1993

[30] Foreign Application Priority Data

Sep. 30, 1992 [JP] Japan ..... 4-261491

[51] Int. Cl.[6] ..... G03D 13/02

[52] U.S. Cl. ..... 354/331; 354/336

[58] Field of Search ..... 354/298, 299, 316–324, 354/331, 336

[56] References Cited

U.S. PATENT DOCUMENTS 3,599,554 8/1971 Aelterman et al. ..... 354/321
4,931,378 6/1990 Hirano et al. ..... 354/320 X
5,043,756 8/1991 Takabayahsi ..... 354/320

FOREIGN PATENT DOCUMENTS 0337174 10/1989 European Pat. Off. ..... 354/324
264635 3/1990 Japan .
2161431 6/1990 Japan .
2162347 6/1990 Japan .

*Primary Examiner*—D. Rutledge
*Attorney, Agent, or Firm*—Sughrue, Mion, Zinn, Macpeak & Seas; Richard C. Turner; George Lehnigk

[57] ABSTRACT

A photosensitive material processing apparatus having a processing tank in which a processing solution for processing a photosensitive material is stored, and rollers or the like for conveying the photosensitive material along a predetermined path within the processing tank. By maintaining a humidity of upper portion spaces of the processing tank at greater than or equal to 80%RH, dirtying of machinery due to crystal deposition of processing chemicals and non-uniformity of the processing solution are prevented. In order to maintain the humidity of the upper portion spaces of the processing tank at greater than or equal to 80%RH, a cover having an opening ratio of less than or equal to 40% is disposed at an upper portion of the processing tank, and spaces enclosed by the cover are not ventilated by fans. Further, it is preferable that a ratio of a volume of the upper portion spaces of the processing tank enclosed by a cover to an area of an exposed surface of the solution within the processing tank is 0.5 $cm^3/cm^2$ to 10 $cm^3/cm^2$.

14 Claims, 3 Drawing Sheets

PHOTOSENSITIVE MATERIAL PROCESSING APPARATUS

BACKGROUND OF THE INVENTION

1. Field of the Invention

The present invention relates to a photosensitive material processing apparatus in which the dirtying of machinery and non-uniformity of processing solutions due to crystal deposition of processing chemicals are prevented.

2. Description of the Related Art

In photosensitive material processing, i.e., developing processing of photosensitive materials, a photosensitive material is conveyed through and submerged for predetermined times in various types of processing solutions stored within processing tanks in an automatic developer.

Conventionally, such processing of photosensitive materials has been carried out in an open system. However, because the respective concentrations of the processing solutions containing processing chemicals become non-uniform due to the evaporation of moisture from the liquid surfaces, processing apparatuses having various types of evaporation preventing means have been proposed.

Japanese Patent Application Laid-Open No. 2-161431 discloses a photosensitive material processing apparatus equipped with a cover which can substantially close the spaces at the upper portions of processing tanks. Further, Japanese Patent Application Laid-Open No. 2-162347 proposes a photosensitive material processing apparatus having a cover, which can substantially close the spaces at the upper portions of processing tanks, and a means for preventing drops of solution from falling downward which has a specific configuration.

Further, U.S. Pat. No. 5,043,756 (Takabayashi et al.) discloses an automatic developing apparatus having a processing tank which is tube-shaped so that processing agents do not contact the air. Because the tank is tube-shaped and includes a small amount of the processing agent, it is necessary to completely cut off the processing agent from the air. Therefore, the structure of the apparatus is complicated, and maintenance thereof is difficult.

Because the spaces closed by the above-mentioned closing cover are larger than the exposed liquid surface, portions of the spaces which are near to the liquid surface are very humid, and the humidity of the portions decreases as the portions are distanced from the liquid surface. The moisture in the processing solutions adhering to the wall surfaces and the like evaporates, and the processing chemicals crystallize. The crystallized processing chemicals adhere to the photosensitive material which transports these crystallized processing chemicals into other processing tanks as processing continues. Such conventional closing covers have therefore been unable to prevent contamination of the processing solutions in other processing tanks.

SUMMARY OF THE INVENTION

In view of the aforementioned, an object of the present invention is to provide a photosensitive material processing apparatus in which dirtying of machinery and non-uniformity of processing solutions due to crystal deposition of processing chemicals can be prevented.

Processing of photosensitive materials, e.g., developing processing of color photography photosensitive materials, is usually effected at 30° C. to 45° C., which is a temperature range efficient for processing. The processing solution within the processing apparatus is heated so that the temperature of the processing solution rises. Crystal deposition of the processing solutions adhering to the wall surfaces and the like increases as compared with crystal deposition at an ordinary temperature. Not only does the apparatus become dirty, but also the crystallized processing chemicals become fixed to the wall surfaces. The deposit of the crystallized chemicals increases and extends into other processing tanks and contaminates the other processing tanks. This results in drawbacks such as non-uniformity of the processing solutions in the other processing tanks, adverse effects on the processing of the photosensitive material, and the like. Therefore, the object of the present invention is to provide an apparatus in which crystal deposition of processing chemicals is prevented and workability is good without the efficiency in processing the photosensitive material being adversely effected.

A first aspect of the present invention is a photosensitive material processing apparatus having a processing tank in which a processing solution for processing a photosensitive material is stored, and a conveying means for conveying the photosensitive material along a predetermined path within the processing tank, comprising means for maintaining a humidity of upper portion spaces of the processing tank at greater than or equal to 80%RH.

A second aspect of the present invention is a photosensitive material processing apparatus having a processing tank in which a processing solution for processing a photosensitive material is stored, and a conveying means for conveying the photosensitive material along a predetermined path within the processing tank, comprising a cover having an opening ratio of less than or equal to 40% and provided at an upper portion of the processing tank, and spaces enclosed by the cover are not ventilated by fans.

A third aspect of the present invention is a photosensitive material processing apparatus having a processing tank in which a processing solution for processing a photosensitive material is stored, and a conveying means for conveying the photosensitive material along a predetermined path within the processing tank, the photosensitive material processing apparatus comprising a cover disposed at an upper portion of the processing tank, a ratio of a volume of upper portion spaces of the processing tank enclosed by the cover disposed at the upper portion of the processing tank to an area of an exposed surface of the solution within the processing tank being 0.5 $cm^3/cm^2$ to 10 $cm^3/cm^2$.

The present invention will be described in more detail hereinafter.

The photosensitive material processing of the present invention includes means for maintaining the humidity of the upper portion spaces of at least one processing tank at 80% or more. The humidity of the upper portion spaces must be greater than or equal to 80%RH, is preferably greater than or equal to 85%RH, and is more preferably greater than or equal to 90%RH. The means may be provided in all of the processing tanks of the photosensitive material processing apparatus. Alternatively, it suffices to provide the means as occasion demands only in those processing tanks using processing chemicals for which crystal deposition is problematic.

When the humidity of the upper portion spaces is less than 80%RH, crystal deposition occurs easily, and it is difficult to achieve the effects-of the present invention. If the humidity of the upper portion spaces is greater than or equal to 80%RH, crystal deposition can be controlled regardless of the ambient temperature. The humidity of a regular work space is 45 to 65%RH. At humidities of less than 60%RH, crystal deposition is especially marked.

Providing a cover at the upper portion of the processing tank is a means for maintaining the spaces at the above-described humidities.

Further, in accordance with the second aspect of the photosensitive material processing apparatus of the present invention, a cover having an opening ratio of less than or equal to 40% is disposed at the upper portion of the processing tank, and the spaces covered by the cover are not ventilated by fans. It is preferable that the opening ratio of the cover is within a range of 5% to 30%, more preferably 5% to 15%. The opening ratio is a ratio of the area of the opening portions to the area of the exposed surface of the processing solution. The area of the opening portions is the total open area where the upper portion spaces of the processing tank contact the outside air, such as the air gaps between the cover and the photosensitive material. When the opening ratio exceeds 40%, the temperature and humidity of the upper portion spaces are easily effected by the outside environment surrounding the photosensitive material processing apparatus, and prevention of crystal deposition becomes difficult. It is especially preferable that the opening ratio is 5% to 15% when the temperature within the processing tank is less than or equal to 30° C. By not ventilating the spaces within the cover by fans and by providing a low opening ratio, not only is a high humidity maintained in the upper portion spaces of the processing tank, but also the evaporation of moisture from the liquid surface can be controlled. Therefore, the structure is even more preferable for maintaining the uniformity of the processing solutions. The upper portion spaces are the upper portions of the spaces above the liquid surface.

In accordance with the third aspect of the photosensitive material processing apparatus of the present invention, the inventors of the present invention discovered that, in order to prevent crystal deposition of the processing solution, it is effective to specify the ratio between, on the one hand, the volume of the upper portion spaces of the processing tank defined by the cover and processing solution surface, and, on the other hand, the volume of the exposed liquid surface. Namely, the ratio of the volume of the upper portion spaces of the processing tank enclosed by the cover disposed at the top portion of the processing tank to the area of the exposed surface of the processing solution within the processing tank is preferably 0.5 $cm^3/cm^2$ to 10 $cm^3/cm^2$, and more preferably 1 $cm^3/cm^2$ to 3 $cm^3/cm^2$. Although smaller ratios are more preferable, a ratio of less than 0.5 $cm^3/cm^2$ may present difficulties in terms of actual design; due to surface tension, the solution may rise in a narrow gap. Further, if the ratio is greater than or equal to 10 $cm^3/cm^2$, the relative humidity of the upper portion spaces drops, and crystal deposition of the processing chemicals occurs easily.

The above-described three aspects of the present invention are each effective in preventing crystal deposition of the processing solutions. However, the effects of the present invention may be improved by arbitrarily combining the three aspects. Namely, as an example, a cover having an opening ratio of less than or equal to 40% is provided and the spaces within the cover are not ventilated by fans in a processing tank which is equipped with means for maintaining the humidity of the upper portion spaces of the processing tank at greater than or equal to 80%RH. In addition/alternatively, a cover is disposed at the upper portion of the processing tank such that the ratio of the volume of the upper portion spaces of the processing tank enclosed by the cover disposed at the upper portion of the processing tank to the area of the exposed surface of the solution within the processing tank is 0.5 $cm^3/cm^2$ to 10 $cm^3/cm^2$.

In the processing apparatus of the present invention, it is preferable that the cover, which also serves to convey a photosensitive material, is set at a processing tank having a large opening portion. The cover is fit with the processing tank at a relatively upper portion of the cover, and maintains the upper portion space of the processing tank enclosed by the cover at a high humidity. Accordingly, even when the apparatus is operated, when the apparatus is stopped, and, in particular, when the apparatus is operated at a high processing temperature, deposition of processing chemicals in the spaces can be prevented. Further, maintenance, such as cleaning or the like, can easily be carried out by merely removing the cover.

Operation of the present invention is described hereinafter.

At a photosensitive material processing apparatus (photographic printing paper printing/developing apparatus), images of a negative film are printed at a printing section onto a withdrawn photographic printing paper by printing light of a light source. Thereafter, the conveying speed of the photographic printing paper is adjusted at a paper reservoir section. Then, the photographic printing paper passes through a color developing tank, a bleaching/fixing tank and a rinsing tank so as to-be subject to a series of developing processes. After being dried in a drying section, the photographic printing paper is cut into images by a cutter, and the images are removed. The cover illustrated in FIGS. 1 and 2 is to be mounted to at least one area of the processing tanks of such an apparatus. By mounting a cover, which serves as a high humidity maintaining means, to each of the processing tanks, the upper portion spaces of the processing tanks are maintained at humidity levels of greater than or equal to 80%RH. Because the upper portion spaces of the processing tanks are maintained at a high humidity, evaporation of the liquid of the processing solution adhering to the wall surfaces of the processing tanks and to the photographic printing paper can be controlled. Because crystal deposition of the processing chemicals included in the processing solutions can be prevented, dirtying of the wall surfaces can be prevented. Further, crystallized processing chemicals do not adhere to the wall surfaces, further crystallize and extend to other processing tanks so as to contaminate other processing tanks. Non-uniformity of the processing chemicals can thereby be prevented. Further, by maintaining the high humidity of the upper portion spaces of the processing tanks, the vapor pressure within the spaces increases, and evaporation of moisture from the surface of the processing solution is restrained so that the processing solution is stable. In order to satisfy the condition of the present embodiment that the humidity of the upper portion spaces of the processing tank is maintained at greater than or equal to 80%RH, the opening ratio of the cover disposed at the upper portion of the processing tank is less than or equal to 40% and preferably 5% to 15%, and the spaces within the cover are not ventilated by fans. It thereby becomes difficult for the spaces within the cover to be effected by the temperature and humidity of the outside. Therefore, the effect of suppressing crystal deposition of the processing chemicals can be improved. At this time, it is not absolutely necessary to completely cover the upper portion spaces of the processing tank. By keeping the opening ratio low as described above, adhering and deposition of the processing solutions can be prevented at times when the photosensitive material is being processed (i.e., when the apparatus is being operated), as well as at times when the apparatus is stopped. Further, when the cover is used, the ratio of the volume of the upper portion spaces of the processing tank enclosed by the cover disposed at the upper portion of the processing tank to the area of the exposed liquid surface within the processing tank may be 0.5 $cm^3/cm^2$ to 10 $cm^3/cm^2$. The ratio of the upper portion spaces can thereby be kept low. As a result, the effect of suppressing crystal deposition of processing-chemicals can be improved.

In accordance with the photosensitive material processing apparatus of the present invention, deposition of crystals from the processing chemicals, especially the color developing solution, within the processing tank can be prevented. Therefore, dirt within the photosensitive material processing tanks does not mix with the processing chemicals in the other processing tanks. As a result, the apparatus can be used continuously without necessitating maintenance such as cleaning or the like over a long period of time. Further, because the interiors of the spaces are maintained at a high humidity, superior effects are achieved in that evaporation of the solution, oxidation of the processing chemicals, and variation in the composition of the solution due to the concentration thereof can be prevented, and the processing solution is stable.

Further, in a conventional photographic processing apparatus known as "Mini-labo", when ventilation is stopped during the night due to the stopping of a fan, moisture evaporates from the liquid surface and condenses on the upper portion of the apparatus, e.g., racks and upper walls of crossover portions. When the bleaching/fixing solution splashes, the components which have been deposited and which have dried on the upper wall dissolve and drop down into the developing tank, resulting in trouble (contamination trouble). Therefore, the upper portion of the processing tank of such an apparatus is opened during the night when the apparatus is not used. Workability is improved in the present invention as there is no need for such an operation.

DESCRIPTION OF THE PREFERRED EMBODIMENTS

Figure 3:
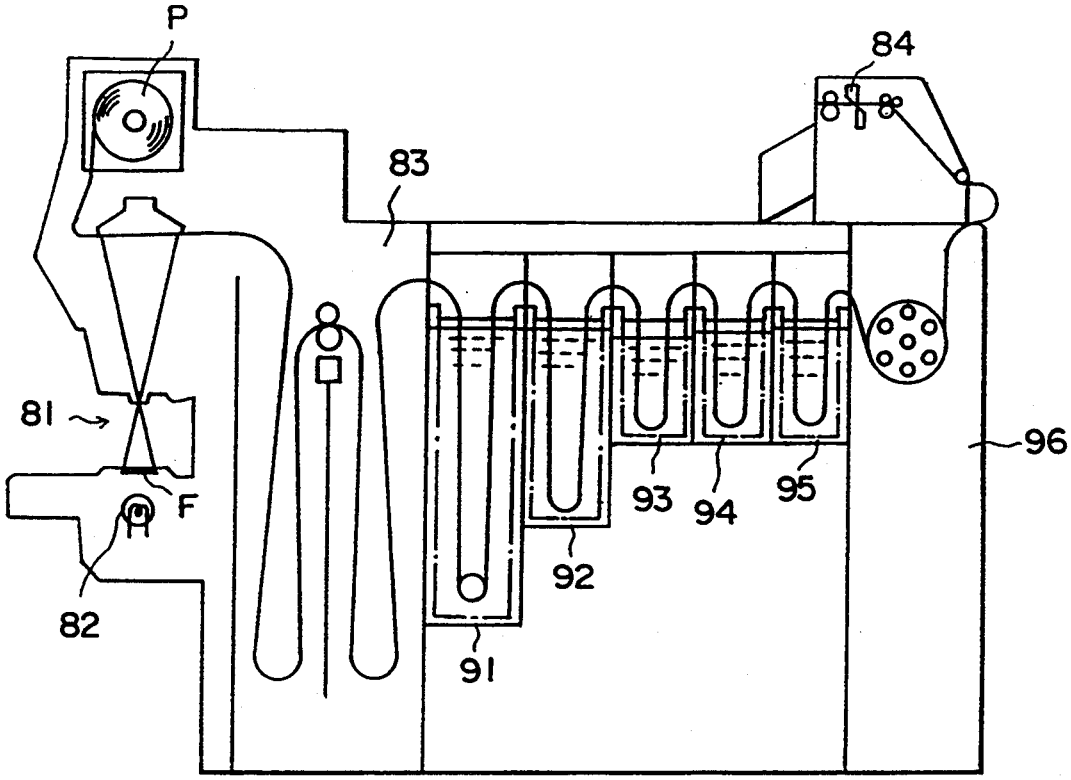
FIG. 3 is a schematic structural view of the photosensitive material processing apparatus of the present invention equipped with a cover.

The present invention will be described by the example given hereinafter. FIG. 3 is a schematic structural view of an ordinary photosensitive material processing apparatus (a photographic printing paper printing-/developing apparatus). In the photographic printing paper printing/developing apparatus, a series of developing processes is effected in the following manner. A photographic printing paper P, which is stored in the form of a roll, is pulled out into a printing section 81. Images of a negative film F are printed onto the photographic printing paper P by printing light from a light source 82. The photographic printing paper P is conveyed, via paper reservoir section 83, to color developing tank 91, bleaching/fixing tank 92, and rinsing tanks 93, 94, 95, successively. After being dried in a drying section 96, the photographic printing paper P is cut into images at a cutter 84. The cover relating to the photosensitive material processing apparatus of the present invention is mounted to at least one area of the processing tanks 91, 92, 93, 94, 95 or the like of such an apparatus.

Figure 1:
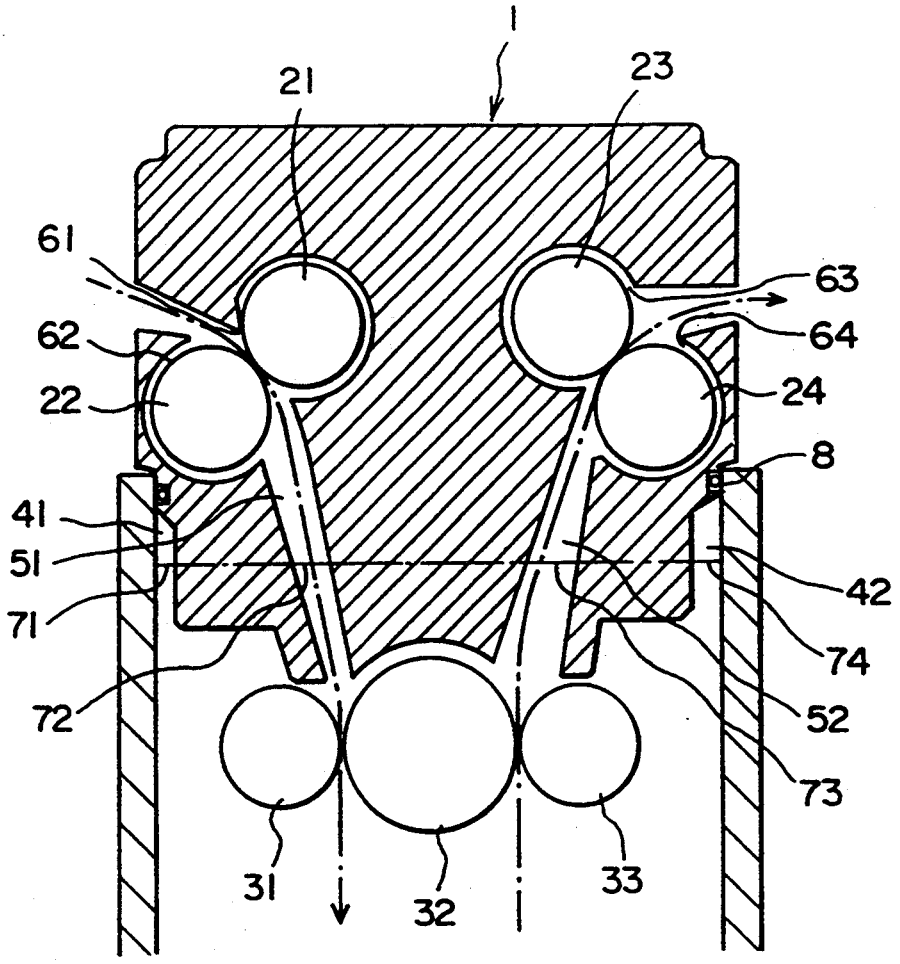
FIG. 1 is a sectional view of a portion of a cover of a photosensitive material processing apparatus of the present invention.

FIG. 1 is a sectional view of a cover 1 which is disposed at a processing tank of the photosensitive material processing apparatus of the present invention. In order to reduce the sectional area of the opening, the space between the cover and the processing tank is sealed by a packing 8. It is preferable that the material used for the packing 8 is a silicon rubber, teflon (polytetrafluoroethylene) rubber, nitryl rubber or the like.

In order to reduce the area of the openings, it is preferable to use flat nip rollers 21, 22, 23, 24 as rollers which serve as the conveying means of the photosensitive material. It is preferable that the cover 1 is formed along the transporting rollers. At this time, the only opening portions are the air gaps between the conveying rollers and the cover, which are illustrated by opening portions 61, 62, 63, 64.

In order to reduce the volume of the spaces of the upper portion of the processing tank and to prevent the rise of the processing solution due to surface tension from the contacting surface, the cover main body is formed such that the upper portion, the side surfaces, and the edge surfaces are formed integrally, or such that the respective portions are integrally joined. The material used for the cover may be selected arbitrarily provided that the material prevents transpiration. Examples of such a material are metal, synthetic resin, and the like. Vinyl chloride, polypropylene, modificated polyphenyleneoxide, modificated polyphenyleneether, polytetrafluoroethylene and the like are preferable.

The cover 1 may be shaped as illustrated in FIG. 1, or alternatively, may be hollow as long as the upper portion spaces of the processing tank are cut off from the outside air as much as possible and the volume thereof is reduced. Further, from the standpoint of decreasing the spaces of the upper portion of the processing tank and decreasing the exposed liquid surface, it is preferable that the lower edge of the cover is disposed further downward than the surface of the processing solution.

The photosensitive material is conveyed by the nip rollers 21, 22, and is submerged for a predetermined time in the processing solution by conveying rollers 31, 32 and other conveying rollers (unillustrated) below the surface of the processing solution. The photosensitive material is conveyed by the conveying rollers 32, 33 and the nip rollers 23, 24 to subsequent processes.

Spaces 41, 42, which are defined by surfaces 71, 74 of the processing solution, outer walls of the processing tank, and the cover 1, form a closed system. The humidity within the spaces 41, 42 remains high due to the high temperature of the processing solution. As a result, the crystallization of processing chemicals within the processing solutions which adhere to the wall surfaces and to the outer side of the cover within the processing tank due to surface tension and vibration is suppressed. It is preferable that the ratio of the volume of the space 41 to the area of the surface 71 of the processing solution and the ratio of the volume of the space 42 to the area of the surface 74 of the processing solution are 0.5 $cm^3/cm^2$ to 10 $cm^3/cm^2$.

Spaces 51, 52, which are defined by surfaces 72, 73 of the processing solution and by the cover 1, are open due to air gaps 61, 62, 63, 64 between the outer side of the cover and the nip rollers 21, 22, 23, 24 which are used to convey the photosensitive material. The opening ratios, i.e., the ratio of the sum of the areas of the air gaps 61, 62 to the area of the exposed surface 72 of the processing solution and the ratio of the sum of the areas of the air gaps 63, 64 to the area of the exposed surface 73 of the processing solution, are respectively less than or equal to 40% (more preferably 5% to 15%). Further, a ventilating means such as a fan or the like is not provided. Therefore, a high humidity is maintained within the spaces 51, 52. The processing chemicals within the processing solution adhering to the surfaces of the photosensitive material do not crystallize, and the processing solution itself is removed when the photosensitive material passes through the nip rollers 23, 24. Consequently, the processing solution does not effect the subsequent processing tank. It is preferable that the ratio of the volume of the space 51 to the area of the surface 72 of the processing solution and the ratio of the volume of the space 52 to the area of the surface 73 of the processing solution are 0.5 $cm^3/cm^2$ to 10 $cm^3/cm^2$, as described above.

Figure 2:
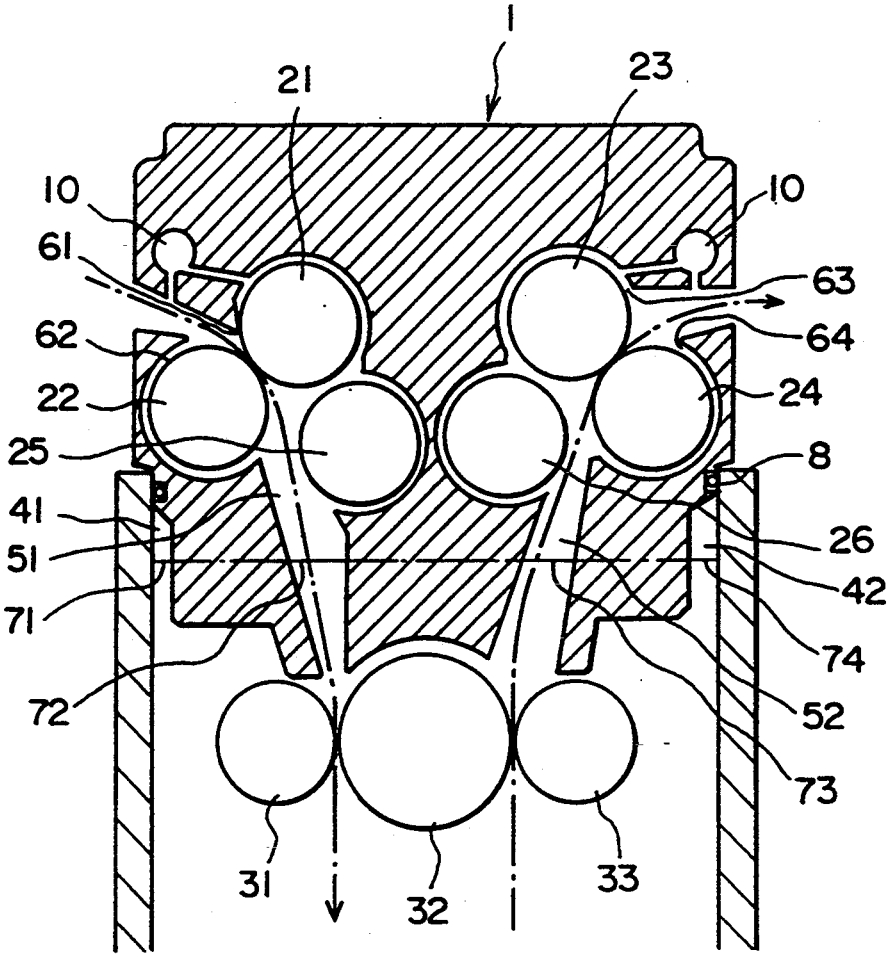
FIG. 2 is a sectional view of a portion of a cover of a photosensitive material processing apparatus of another aspect of the present invention which is equipped with an automatic washing mechanism.

In the photosensitive material processing apparatus of the present invention, automatic washing mechanisms 10 such as those illustrated in FIG. 2 can be provided in the cover. Washing water supplied from the automatic washing mechanisms 10 is maintained between the nip rollers 22, 24 and the cover. Therefore, opening portions of the air gaps 62, 62 are closed off by the washing water. Further, the washing water supplied onto the nip rollers 21, 23 is maintained in the gaps between the nip rollers 21, 23 and the cover by surface tension and the rotation of the guide rollers 25, 26. Accordingly, the structure is even more preferable for maintaining the upper portion spaces of the processing tank at high humidities because the air gaps 61, 62, 63, 64 are closed by the washing water.

In the photosensitive material processing apparatus of the present invention, crystal deposition of the processing chemicals is suppressed not only during processing of the photosensitive material, i.e., not only when the processing solutions are being heated, but also at times when the processing solutions are not heated, such as at night. The processing tanks and the cover do not become dirty, and there is no need for cleaning over a long period of time.

The processing solutions and the photosensitive material used in the photosensitive material processing apparatus of the present invention are not particularly limited and can be used at any of the processing stages. However, the effects of the present invention are particularly noticeable in developing processing of color photography photosensitive materials for which crystal deposition is particularly problematic.

Hereinafter, a description will be given using examples of various processing chemicals, photosensitive materials and the like which can be used in the photosensitive material processing apparatus of the present invention. However, processing chemicals and the like which can be used are not limited to the following examples.

Color developing solutions used in the photosensitive material processing apparatus of the present invention are described hereinafter.

The color developing solution used in the photosensitive material processing apparatus of the present invention includes commonly-known aromatic primary amine color developing agents. A preferable example is a p-phenylenediamine derivative. Typical examples of color developing agents are N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl)amino]aniline, 4-amino-3-methyl-N-ethyl-N-[β-(methansulfonamide)ethyl]-aniline, N-(2-amino-5-dienylaminophenylethyl)methansulfonamide, N,N-dimethyl-p-phenylenediamine, 4-amino-3-methyl-N-ethyl-N-methoxyethylamine, 4-amino-3-methyl-N-ethyl-N-β-etoxyethylaniline, 4-amino-3-methyl-N-ethyl-N-β-butoxyethylaniline. 4-amino-3-methyl-N-ethyl-N-[β(methansulfonamide)ethyl]-aniline is especially preferable.

Further, the p-phenylenediamine derivative may be a salt such as sulfate, hydrochloride, sulfite, p-toluenesulfonic acid salt, or the like. The amount of the aromatic primary amine color developing agent used per 1 liter of color developing solution is preferably of a concentration of about 0.1 g to about 20 g, and more preferably about 0.5 g to about 10 g.

The concentration of the replenishing solution is preferably greater than or equal to 8 g/liter, and more preferably greater than or equal to 9 g/liter. It is especially preferable to use 4-amino-3-methyl-N-ethyl-N-[β(methansulfonamide)ethyll-aniline.

In the embodiment of the present invention, it is preferable to use a color developing solution containing substantially no benzyl alcohol. Here, substantially no benzyl alcohol refers to a benzyl alcohol concentration of preferably less than or equal to 2 ml/liter, and more preferably less than or equal to 0.5 ml/liter. It is most preferable that the color developing solution contains no benzyl alcohol at all.

It is preferable that the color developing solution used in the photosensitive material processing apparatus of the present invention contains substantially no sulfurous acid ions (here, substantially no sulfurous acid ions refers to a sulfurous acid ion concentration of less than or equal to $3.0\times10^{-3}$ mol/liter). It is preferable that the sulfurous acid ion concentration is less than or equal to $1.0\times10^{-3}$ mol/liter, and most preferable that there are no sulfurous acid ions at all. However, an extremely small amount of sulfurous ions, which is used as an oxidation inhibitor of a processing kit in which the developing agent is concentrated before water is added to the solution to be used, may be excluded from the amounts of sulfurous acid ions mentioned in the above description.

It is more preferable that the color developing solution used in the photosensitive material processing apparatus of the present invention contains an organic preservative rather than hydroxylamine and sulfurous acid ions.

Organic preservatives refer in general to organic compounds which are added to the processing solution of the color photography photosensitive material and mitigate the speed of deterioration of the aromatic primary amine color developing agent. Namely, organic preservatives are organic compounds which function to prevent oxidation of the color developing agent due to air or the like. Especially effective organic preservatives are hydroxamie acids, hydrazincs, hydrazides, phenols, α-hydroxyketones, α-aminoketones, saccharides, monoamines, diamines, polyamines, quaternary ammonium salts, nitroxy radicals, alcohols, oximes, diamide compounds, condensed ring type amines. Such organic preservatives are disclosed in Japanese Patent Application Publication No. 48-30496. Japanese Patent Application Laid-Open Nos. 52-143020, 63-4235, 63-30845, 63-21647, 63-44655, 63-53551, 63-43140, 63-56654, 63-58346, 63-43138, 63-146041, 63-44657, 63-44656, U.S. Pat. No. 3,615,503, U.S. Pat. No. 2,494,930, Japanese Patent Application Laid-Open Nos. 1-97953, 1-186939, 1-186940, 1-187557, 2-306244, and the like. Other preservatives may be utilized as occasion demands. Examples of such other preservatives include various metals disclosed in Japanese Patent Application Laid-Open Nos. 57-44148, 57-53749; salicylic acids disclosed in Japanese Patent Application Laid-Open No. 59-180588; amines disclosed in Japanese Patent Application Laid-Open Nos. 63-239447, 63-128340, 1-186939, 1-187557; alkanolamines disclosed in Japanese Patent Application Laid-Open No. 54-3532; polyethyleneimincs disclosed in Japanese Patent Application Laid-Open No. 56-94349; and aromatic polyhydroxy compounds disclosed in U.S. Pat. No. 3,746,544, and the like. In particular, alkanolamines such as triethanolamine, dialkylhydroxylamines such as N,N-diethylhydroxylamine and N,N-di(sulfoethyl)hydroxyamine, and hydrazine derivatives (except hydrazine) such as N,N-bis(carboxymethyl)hydrazine may be used. Alternatively, it is preferable to add aromatic polyhydroxy compounds such as sodium catechol-3,5-disulfonlc acid.

In particular, it is preferable to use dialkylhydroxylamine and/or a hydrazine derivative together with alkanolamines.

It is preferable that the amount of chlorine ions included in the color developing solution used in the photosensitive material processing apparatus of the present invention is $3.0\times10^{-2}$ to $1.5\times10^{-1}$ mol/liter. It is especially preferable that the amount included is $3.5\times10^{-2}$ to $1\times10^{-3}$ mol/liter.

It is preferable that the amount of bromine ions included in the color developing solution used in the photosensitive material processing apparatus of the present invention is $3.0\times10^{-5}$ to $1.0\times10^{-1}$ mol/liter. It is more preferable that the amount included is $5.0\times10^{-5}$ to $5\times10^{-4}$ mol/liter.

Chlorine ions and bromine ions may be added directly to the color developing solution, or may be eluted into the color developing solution from the photosensitive material during the developing process.

Sodium chloride, potassium chloride, ammonium chloride, lithium chloride, magnesium chloride, and calcium chloride are examples of chlorine ion supplying substances when ions are to be directly added to the color developing solution. Further, chlorine ions may be supplied from a fluorescent brightening agent added to the color developing solution.

Sodium bromide, potassium bromide, ammonium bromide, lithium bromide, magnesium bromide, and calcium bromide are examples of bromine ion supplying substances. When ions are to be eluted from the photosensitive material during developing processing, chlorine ions or bromine ions may be supplied together with an emulsion, or may be supplied from a source other than an emulsion.

It is preferable that the pH of the color developing solution used in the photosensitive material processing apparatus of the preset invention is 9 to 12, and more preferable that the pH is 9 to 11.0. Compounds of other known developing solution components can be included in the color developing solution to be used in the present invention.

It is preferable to use various buffers in order to maintain the pH. Carbonate, phosphate, borate, tetraborate, hydroxybenzoate, glycyl acid, N,N-dimethylglycyl salt, leucine salt, norleucine salt, guanine salt, 3,4-dihydroxyphenylalanine salt, alanine salt, aminoacetic acid salt, 2-amino-2-methyl-1,3-propanediol, valine salt, proline salt, trishydroxyaminomethane salt, lysine salt and the like can be used as buffers. In particular, carbonate, phosphate, tetraborate and hydroxybenzoate have excellent solubility and exhibit an outstanding buffer performance in a high pH region of greater than or equal to 9.0. Further, even if these buffers are added to the color developing solution, they do not adversely effect the photographic performance (e.g., there is no fogging or the like). Moreover, they are low-cost. It is therefore especially preferable to use these buffers.

Specific examples of such buffers include sodium carbonate, potassium carbonate, disodium carbonate, dipotassium carbonate, trisodium phosphate, tripotassium phosphate, disodium phosphate, dipotassium phosphate, sodium borate, potassium borate, sodium tetraborate (borax), potassium tetraborate, o-sodium benzoate (sodium salicylate), o-potassium benzoate, 5-sulfo-2-sodium benzoate (5-sodium salicylate), 5-sulfo-2-potassium benzoate (5-potassium salicylate).

It is preferable that the amount of the buffer added to the color developing solution is greater than or equal to 0.1 mol/liter, and 0.1 mol/liter to 0.4 mol/liter is especially preferable.

In the color developing solution, various chelating agents can be used as calcium or magnesium suspending agents or in order to improve the stability of the color developing solution. Examples of chelating agents include nitrilotriacetate, diethylenetriaminepentaacetic acid, ethylenediaminetetraacetic acid, N,N,N-trimethylenephosphonic acid, ethylenediamine-N,N,N',N'-tetramethylenephosphonic acid, trans-silohexanediaminetetraacetic acid, 1,2-diaminepropane tetraacetate, glycoletherdiamine tetraacetate, ethylenediamineorthohydroxyphenylacetate, 2-phosphonebutane-1,2,4-tricarboxylic acid, 1-hydroxylethylidene-1,1-diphosphonic acid, N,N-bis(2-hydroxybenzyl-)ethylenediamine-N,N'-diacetate, hydroxyethyliminodiacetic acid. Two or more chelating agents may be used together as occasion demands. It suffices that the amount of chelating agent added is sufficient to block the metal ions in the color developing solution, for example, about 0.1 g to 10 g per 1 liter.

A development accelerator can be added arbitrarily to the color developing solution as occasion demands.

Thioether compounds are disclosed as development accelerators in Japanese Patent Application Publication Nos. 37-16088, 37-5987, 38-7826, 44-12380, 45-9019, U.S. Pat. No. 3,813,247, and the like. p-phenylenediamine compounds are disclosed in Japanese Patent Application Laid-Open Nos. 52-49829 and 50-15554. Quaternary ammonium salts are used in Japanese Patent Application Laid-Open No. 50-137726, Japanese Patent Application Publication No. 44-30074, and Japanese Patent Application Laid-Open Nos. 56-156826, 52-43429. Amine compounds are disclosed in U.S. Pat. Nos. 2,494,903; 3,128,182; 4,230,796; 3,253,919; Japanese Patent Application Publication No. 41-11431; U.S. Pat. Nos. 2,482,546; 2,596,926; 3,582,346; and the like. Polyalkyleneoxide is used in Japanese Patent Application Publication Nos. 37-16088, 42-25201, U.S. Pat. No. 3,128,183, Japanese Patent Application Publication Nos. 42-11431, 42-23883, and U.S. Pat. No. 3,532,501. 1-phenyl-3-pyrazolidones, imidazoles and the like can be added as occasion demands. The above description relating to benzyl alcohol is applicable here as well.

An arbitrary antifoggant can be added as occasion demands to the color developing solution used in the photosensitive material processing apparatus relating to the present invention. Alkali metal halides such as sodium chloride, potassium bromide, and potassium iodide, and organic antifoggants can be used as the antifoggant. Examples of organic antifoggants are nitrogen containing hetero cyclic compounds such as enzotriazole, 6-nitrobenzimidazole, 5-nitroisoindazole, 5-methylbenzotriazole, 5-nitrobenzotriazole, 5-chlorobenzotriazole, 2-thiazolyl-benzoimidazole, 2-thiazolylmethyl-benzoimidazole, indazole, hydroxyazaindolyzene, and adanine.

It is preferable that a fluorescent brightening agent is included in the color developing solution used in the photosensitive material apparatus of the present invention. It is preferable to use a 4,4'-diamine-2,2'-disulfostilbene compound as the fluorescent brightening agent. The amount added is 0 to 5 g/liter, and preferably 0.1 to 4 g/liter.

As occasion demands, various surfactants may be added such as alkyl sulfonic acid, allyl sulfonic acid, aliphatic carboxylic acid, aromatic carboxylic acid, polyalkyleneimine and the like.

The processing temperature of the color developing solution used in the photosensitive material processing apparatus of the present invention is 20° to 50° C., preferably 30° to 45° C., and most preferably 37° to 42° C. The processing time is 20 seconds to 5 minutes, and preferably 25 seconds to 1 minute. It is preferable that the replenished amount of the color developing solution is small. Per 1 $m^2$ of photosensitive material, 20 to 600 ml is appropriate, 30 to 200 ml is preferable, and 40 to 100 ml is even more preferable.

Desilverizing processing is effected after color developing. In desilverizing processing, bleaching processing and fixing processing may be carried out separately, or may be effected simultaneously (bleaching/fixing processing). In order to effect processing rapidly, bleaching/fixing processing may be effected after bleaching processing. Processing can be carried out in two connected bleaching and fixing baths, or fixing processing can be effected before bleaching/fixing processing, or bleaching processing can be effected after bleaching-/fixing processing; the order of processing may be selected arbitrarily in accordance with the goal of the processing.

Examples of bleaching agent used in bleaching solution or bleaching/fixing solution include iron salts, iron (III), cobalt (III), chromium (IV), copper (II), polyvalent metal salt compounds, peracids, quinones and nitrocompounds. Examples of typical bleaching agents include iron chloride, ferricyanide compounds, bichromate, organic complex salts of iron (III) (e.g., metal complex salts of aminopolycarboxylic acids such as ethylenediamine tetraacetate, diethylenetriamine pentaacctate, cyclohexanediamine tetraacetate, methylimino diacetate, 1,3-diaminepropane tetraacetate, glycoletherdiamine tetraacetate and the like), persulfates, bromates, permanganates, and nitrobenzenes. Among these, aminopolycarboxylic acid iron (III) complex salts such as ethylenediamine tetraacetate iron (III) complex salt and 1,3-diaminepropane tetraacetate iron (III) complex salt are preferable from the standpoints of rapid processing and prevention of environmental pollution. Further, aminopolycarboxylic acid iron (III) complex salt is especially effective in bleaching solution or in bleaching/fixing solution. A bleaching solution or bleaching/fixing solution containing aminopolycarboxylic acid iron (III) complex salt should be used at a pH of 3 to 8.

Commonly known addition products including rehalogenizing agents such as ammonium bromide and ammonium chloride, pH buffers such as ammonium nitrate, and metal corrosion preventing agents such as ammonium sulfate can be added to the bleaching solution or the bleaching/fixing solution.

Other than the above-described compounds, it is preferable that the bleaching solution or the bleaching-/fixing solution contains an organic acid in order to prevent bleaching stains. Compounds having an acid dissociation constant (pKa) of 2 to 5.5 are especially preferable organic acids. Concretely, acetate, proprionic acid, and the like are preferable.

Examples of the fixing agent used in the fixing solution or the bleaching/fixing solution include thiosulfate, thiocyanate, thioether compounds, thioureas, and a large amount of iodide salts. Usually thiosulfate is used, and ammonium thiosulfate in particular has the widest range of use. Further, it is preferable to use thiosulfate together with thiocyanate, thioether compounds, thioureas, or the like.

As a preservative in the fixing solution or bleaching-/fixing solution, it is preferable to use sulfurous acid salt, bisulfite, a carbonylbisulfite addition product or a sulfinic acid compound, which is disclosed in European Patent No. 294,769A2. Further, it is preferable to add various aminocarboxylic acids and phosphonic acids (for example, 1-hydroxyethylidene-1,1-diphosphonic acid, N,N,N',N'-ethylenediaminetetraphosphonic acid) to the fixing solution or the bleaching/fixing solution in order to stabilize the solution.

The bleaching solution or the bleaching/fixing solution can also contain various fluorescent brightening agents, antifoaming agents, surfactants, polyvinyl pyrrolidone, methanol and the like.

A bleaching accelerator can be used as occasion demands in the bleaching solution, the bleaching/fixing solution, and in solutions of processes preceding these solutions. Concrete examples of effective bleaching accelerators include compounds having a mercaptol radical or a disulfide bond as disclosed in U.S. Pat. No. 3,893,858, West German Patent No. 1,290,812, Japanese Patent Application Laid-Open No. 53-95360, Research Disclosure No. 17129 (July 1978), and the like; thiazolidine derivatives discussed in Japanese Patent Application Laid-Open No. 50-140129; thiourea derivatives used in U.S. Pat. No. 3,706,561; iodide salts disclosed in Japanese Patent Application Laid-Open No. 58-16235; polyoxyethylene compounds mentioned in West German Patent No. 2,748,430; polyamine compounds disclosed in Japanese Patent Application Publication No. 45-8836; bromide ions, and the like. Among these, compounds having a mercaptol radical or a disulfide bond are preferable from the standpoint of their effects on acceleration. In particular, the compounds disclosed in U.S. Pat. No. 3,893,858, West German Patent No. 1,290,812, and Japanese Patent Application Laid-Open No. 53-95630 are especially preferable. The compounds disclosed in U.S. Pat. No. 4,552,834 are also preferable. The bleaching accelerator may be added in the photosensitive material. These bleaching accelerators are especially effective in the bleaching/fixing of color photosensitive materials used for photography.

It is preferable that the total time for desilverizing processing is short and is within a range in which defects due to desilverization do not occur. A preferable time is 10 seconds to 3 minutes, and 20 seconds to 2 minutes is more preferable. Further, the processing temperature is 25° C. to 50° C., preferably 35° C. to 45° C. In a preferable temperature range, the speed of desilverization improves and generation of stains after processing can be effectively prevented.

It is preferable to effect mixing as strongly as possible during desilverizing processing. The following are specific examples of strengthening the mixing which are disclosed in Japanese Patent Application Laid-Open Nos. 62-183460 and 62-183461: a method of colliding a jet of processing solution against the emulsion surface of the photosensitive material; a method in which a mixing effect is provided by use of the rotating means of Japanese Patent Application Laid-Open No. 62-183461; a method of improving the mixing effect by moving the photosensitive material while a wiper blade provided within the solution contacts the emulsion surface so as to make the emulsion surface turbulent; and a method of increasing the total amount of processing solution circulated. These methods for improving mixing are effective for bleaching solution, bleaching/fixing solution, and fixing solution. Improving mixing accelerates the supply of the bleaching agent and the fixing agent into the emulsion membrane which effectively increases the speed of desilverization. Further, the above-described mixing improving methods are even more effective in cases in which a bleaching accelerator is used. The acceleration effect can be markedly improved, and the inhibiting of the fixing by the bleaching accelerator can be eliminated.

It is preferable that the automatic developer used in the photosensitive material processing apparatus of the present invention has a photosensitive material conveying means such as that disclosed in Japanese Patent Application Laid-Open Nos. 60-191257, 60-191258, 60-191259. Such a conveying means can markedly reduce the transport of the processing solutions from baths of earlier processes to baths of later processes so as to prevent the deterioration of the performances of the respective processing solutions. Such effects are especially effective in shortening the processing time of each process and in reducing the amount of processing solution to be replenished.

The color photosensitive material processed by the photosensitive material processing apparatus of the present invention generally undergoes washing processing after being subject to desilverizing processing. A stabilizing process may be effected instead of the washing process. Commonly-known methods of stabilization processing such as those disclosed in Japanese Patent Application Laid-Open Nos. 57-8543, 58-14834, and 60-220345 can be used. Further, a washing/stabilizing process may be effected in which the final bath is a stabilizing bath containing dye stabilizing agents and surfactants typically used in the processing of color photography photosensitive materials used for photography.

The washing solution and the stabilizing solution can contain water softeners such as organic aminophosphonic acid; metal salts such as magnesium salt, aluminum salt, and bismuth salt; surfactants; hardening agents and the like.

The amount of washing water in the washing process can be set over a wide range in accordance with various conditions such as the characteristics of the photosensitive material (e.g., the chemicals used in the coupler and the like), the use of the photosensitive material, the method of replenishment, e.g., the temperature of the wash, the number of washing tanks (number of stages), counter current and forward current, and other conditions as well. Further, in a multi-stage counter current method, there exist drawbacks such as the propagation of bacteria when the amount of washing water is greatly reduced and the adhering of suspended matter to the photosensitive material. A method to reduce calcium ions and magnesium ions disclosed in Japanese Patent Application Laid-Open No. 62-288828 is extremely effective as a method of solving such drawbacks. Moreover, chlorine germicides such as isothiazole compounds, cyabendazoles, and chlorinated sodium isocyanuric acid, which are disclosed in Japanese Patent Application Laid-Open No. 57-8542, can be used. Benzotriazole, as well as germicides disclosed in "The Chemistry of Anti-Germ and Anti-Fungal Agents" (Dr. Horiguchi, 1986, Sankyo Publishing Company), "Sterilization, Germicide and Anti-Fungal Technologies for Micro-Organisms" (edited by the Hygiene Technology Society, 1982, published by the Industrial Technology Society), and "Anti-Germ and Anti-Fungus Dictionary" (edited by the Japan Anti-Germ and Anti-Fungus Society, 1986) can also be used.

The pH of the washing water is 4 to 9 and preferably 5 to 8. The temperature of the washing water and the washing time can be set in various ways based on conditions such as the characteristics, use and the like of the photosensitive material. However, generally, ranges of 15° C. to 45° C. and 20 seconds to 10 minutes, preferably 25° C. to 40° C. and 30 seconds to 5 minutes are selected.

Examples of dye stabilizing agents which can be used in the stabilizing solution include aldehydes such as formalin and glutaraldehyde, N-methylol compounds, and hexamethylenetetramine or aldchyde sulfite addition products. Further, the stabilizing solution can contain pH maintenance buffers such as boric acid and sodium hydroxide; 1-hydroxyethylidene-1,1-diphosphonic acid; chelating agents such as ethylenediamine tetraacetate; sulfidization preventing agents such as alkanolamine; fluorescent brightening agents; anti-fungal agents; and the like.

The solution which overflows when the washing and/or stabilizing solutions are replenished can be reused in the desilverizing process or in other processes.

Although the present invention may be applied to any processing tank, it is preferably used in a color developing tank. The present invention is particularly effective for developing solutions which contain little or no benzyl alcohol and sulfite ions, and for developing solutions having a relatively high concentration of chlorine ions.

EXPERIMENTAL EXAMPLE 1

Effects of the present invention will be concretely described hereinafter by using an experimental example. However, the present invention is not limited to this example.

Developing processing of color paper was effected continuously for three months by a photosensitive material processing apparatus such as that illustrated in FIG. 2 in which the humidity within the spaces 41, 42, 51, 52 disposed in the cover was maintained at 85% RH. The condition of the inner walls of the processing tanks was inspected, and no dirt due to deposition of processing chemicals could be detected in the color developing processing tank nor the other tanks by the naked eye. Here, the opening rate was 12%, and the ratio of the area of the exposed liquid surface within the processing tank to the volume of the spaces of the upper portion of the processing tank which was enclosed by the cover disposed at the spaces of the upper portion of the processing tank was 2 $cm^3/cm^2$. The processing stages and the processing chemicals used are described below.

After image exposure, continuous processing (running test) was effected using a paper processor and the following processing stages.

| Processing Stage | Temperature | Time | Amount Replenished (per 1 $m^2$ of photosensitive material) |
|---|---|---|---|
| color developing | 38.5° C. | 45 sec. | 73 milliliters |
| bleaching/fixing | 35° C. | 45 sec. | 60 milliliters |
| rinsing (1) | 35° C. | 30 sec. | — |
| rinsing (2) | 35° C. | 30 sec. | — |
| rinsing (3) | 35° C. | 30 sec. | 360 milliliters |
| drying | 80° C. | 60 sec. | |

(Rinsing from (3) to (1) was effected by a three tank counter current method)

| Color Developing Solution | Tank Solution | Replenishing Solution |
|---|---|---|
| water | 800 ml | 800 ml |
| ethylenediamine tetraacetate | 3.0 g | 3.0 g |
| 4,5-dihydroxidebenzene-1,3-disulfonic acid 2 sodium salt | 0.5 g | 0.5 g |
| triethanolamine | 12.0 g | 12.0 g |
| potassium chloride | 6.5 g | — |
| potassium bromide | 0.03 g | — |
| potassium carbonate | 27.0 g | 27.0 g |
| fluorescent brightening agent (WHITEX 4 manufactured by Sumitomo Chemicals) | 1.0 g | 1.0 g |
| sodium sulfite | 0.1 g | 0.1 g |
| disodium-N,N-di(sulfonateethyl)hydroxylamine | 5.0 g | 5.0 g |
| triisopropyl naphthalene (β) sodium sulfonic acid | 0.1 g | 0.1 g |
| N-ethyl-(β-methanesulfonamideethyl)-3-methyl-4-aminoaniline 3/2 sulfatemonohydrate | 5.0 g | 11.5 g |
| water to make | 1000 ml | 1000 ml |
| pH (25° C./potassium hydroxide and sulfuric acid) | 10.00 | 11.00 |

-continued

| Bleaching/Fixing Solution | Tank Solution | Replenishing Solution |
|---|---|---|
| water | 600 ml | 600 ml |
| ammonium thiosulfate (700 g/liter) | 100 ml | 250 ml |
| ammonium sulfite | 40 g | 100 g |
| ammonium ethylenediaminetetraacetato/iron (III) | 55 g | 135 g |
| ethylenediamine tetraacetic acid | 5 g | 12.5 g |
| ammonium bromide | 40 g | 75 g |
| nitric acid (67%) | 30 g | 65 g |
| water to make | 1000 ml | 1000 ml |
| pH (25° C./acetic acid and aqueous ammonia) | 5.8 | 5.6 |

| Rinsing Solution (tank solution and replenishing solution were same) | |
|---|---|
| chlorinated sodium isocyanuric acid | 0.02 g |
| deionized water (conductivity less than or equal to 5μ s/cm) | 1000 ml |
| pH | 6.5 |

Including an automatic washing device for washing the processing chemicals, such as that illustrated in FIG. 2, in the photosensitive material processing apparatus of the present invention is preferable from the standpoint of decreasing the opening ratio and preventing the processing chemicals from being transferred into other processing tanks.

Processing was effected in the same manner in an open system without a cover. After 14 days, the system was inspected, and dirt caused by deposition of the processing chemicals on the inner walls of the processing tanks could be seen by the naked eye.

What is claimed is:

1. A photosensitive material processing apparatus comprising:

means for conveying a photosensitive material along a predetermined path within a processing tank in which a processing solution for processing the photosensitive material is stored; and means for maintaining a humidity of upper portion spaces of the processing tank at greater than or equal to 80% relative humidity.

2. A photosensitive material processing apparatus according to claim 1, wherein a space between said processing tank and a cover is sealed by a packing formed by a sealing member made of an elastic material.

3. A photosensitive material processing apparatus according to claim 1, wherein a cover having an opening ratio of less than or equal to 40% is provided at an upper portion of said processing tank, spaces enclosed by said cover are not ventilated by fans, and a ratio of a volume of upper portion spaces of said processing tank enclosed by said cover disposed at the upper portion of said processing tank to an area of an exposed surface of the solution within said processing tank is 0.5 $cm^3/cm^2$ to 10 $cm^3/cm^2$.

4. A photosensitive material processing apparatus according to claim 3, wherein edge surfaces of an inner wall of said cover are disposed below a liquid surface of the processing solution.

5. A photosensitive material processing apparatus according to claim 3, wherein said processing tank is a color developing tank.

6. A photosensitive material processing apparatus according to claim 1, wherein edge surfaces of an inner wall of a cover are disposed below a liquid surface of the processing solution, and an upper portion, side surfaces and edge surfaces of said cover are one of integrally formed and integrally connected.

7. A photosensitive material processing apparatus comprising:

means for conveying a photosensitive material along a predetermined path within a processing tank in which a processing solution for processing the photosensitive material is stored; and a cover having an opening ratio of less than or equal to 40% and provided at an upper portion of said processing tank, and spaces enclosed by said cover are not ventilated by fans.

8. A photosensitive material processing apparatus according to claim 7, wherein said opening ratio of said cover is 5% to 30%.

9. A photosensitive material processing apparatus according to claim 7, wherein said conveying means is a pair of nip rollers, and an automatic washing mechanism, which supplies washing water and washes said nip rollers, is disposed within said cover so that the washing water is maintained in air gaps between said cover and said nip rollers.

10. A photosensitive material processing apparatus according to claim 9, wherein the washing water is maintained in the air gaps between said cover and said nip rollers and in the air gaps between said nip rollers.

11. A photosensitive material processing apparatus according to claim 7, wherein an upper portion, side surfaces and edge surfaces of said cover are one of integrally formed and integrally connected.

12. A photosensitive material processing apparatus comprising:

a processing tank in which a processing solution for processing a photosensitive material is stored;

a conveying means for conveying the photosensitive material along a predetermined path within said processing tank;

a cover disposed at an upper portion of said processing tank; wherein a ratio of a volume of upper portion spaces of said processing tank enclosed by said cover disposed at the upper portion of said processing tank to an area of an exposed surface of the solution within said processing tank being 0.5 $cm^3/cm^2$ to 10 $cm^3/cm^2$.

13. A photosensitive material processing apparatus according to claim 12, wherein said ratio is 1 $cm^3/cm^2$ to 3 $cm^3/cm^2$.

14. A photosensitive material processing apparatus according to claim 12, wherein edge surfaces of an inner wall of said cover are disposed below a liquid surface of the processing solution.

* * * * *